United States Patent [19]

Michalicka et al.

[11] Patent Number: 4,478,421

[45] Date of Patent: Oct. 23, 1984

[54] DART BODY WITH A SPINNING HEAD

[76] Inventors: John A. Michalicka; John N. Michalicka, both of 249 Whitehall Rd., South, Garden City, N.Y. 11530

[21] Appl. No.: 542,417

[22] Filed: Oct. 17, 1983

[51] Int. Cl.[3] ..... A63B 65/02

[52] U.S. Cl. ..... 273/420

[58] Field of Search ..... 273/419, 420, 423, 416

[56] References Cited

U.S. PATENT DOCUMENTS 3,547,463 9/1970 Turner ..... 273/420

FOREIGN PATENT DOCUMENTS 278046 9/1927 United Kingdom ..... 273/420
534289 3/1941 United Kingdom ..... 273/423
589208 6/1947 United Kingdom ..... 273/423
717352 10/1954 United Kingdom ..... 273/423
1508075 4/1978 United Kingdom ..... 273/423

*Primary Examiner*—Paul E. Shapiro

[57] ABSTRACT

This dart body is designed to enable a player to throw a tight group of darts, without one of the darts deflecting from a stationary dart on the target. Primarily, it consists of an aluminum main body, which is rotatable on a steel shaft that is stationary within the tail portion of the structure.

1 Claim, 5 Drawing Figures

FIG. 1
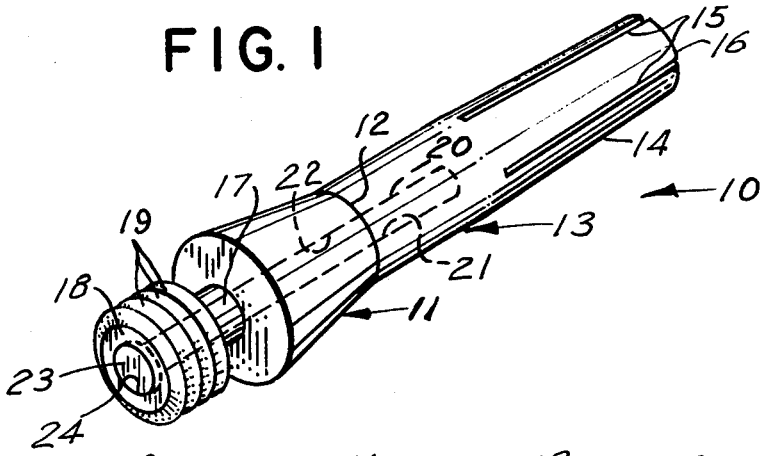
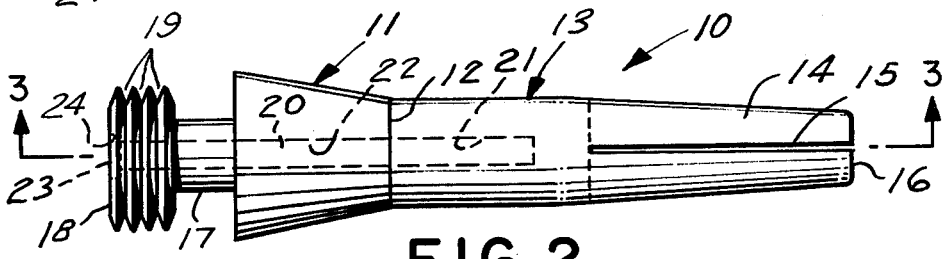
FIG. 2
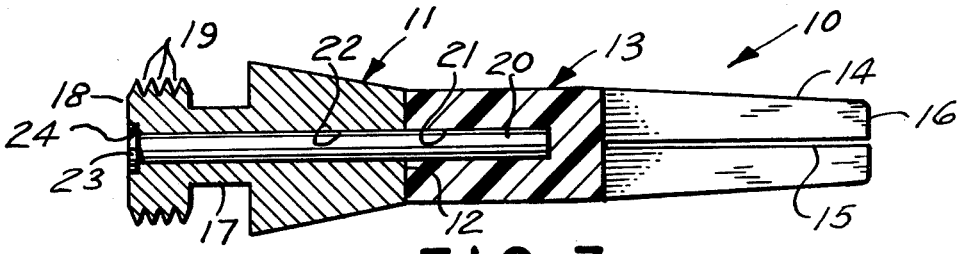
FIG. 3
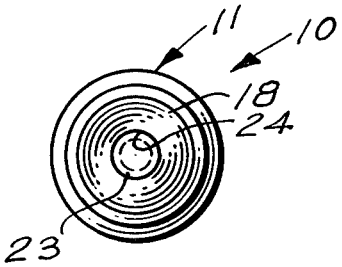
FIG. 4
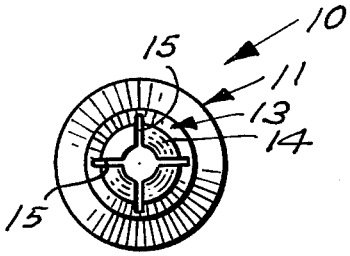
FIG. 5

DART BODY WITH A SPINNING HEAD

This invention relates to darts, and more particularly, to a dart body with a spinning head.

The principal object of this invention is to provide a dart body with a spinning head, which will be employed for playing the game of darts, and it will enable a player to throw a tight group of darts, that was not possible with darts of the prior art.

Another object of this invention is to provide a dart body with a spinning head, which will be unique in design, so as to prevent it from deflecting away from a stationary dart on the target when it strikes it, thus causing it to remain in the immediate target strike area, for producing a tighter dart group for better point scoring.

Another object of this invention is to provide a dart body with a spinning head, which will spin on contact with a stationary dart on the target, because its head will rotate on impact with the on-target dart.

A further object of this invention is to provide a dart body with a spinning head, which will have its head portion fully rotatable on its tail portion.

Other objects are to provide a dart body with a spinning head, which is simple in design, inexpensive to manufacture, rugged in construction, easy to use, and efficient in operation.

These, and other objects, will be readily evident, upon a study of the following specification, and the accompanying drawing, wherein:

FIG. 1 is a perspective view of the present invention, showing the stabilizing fins removed therefrom;

FIG. 2 is an enlarged side elevational view of FIG. 1;

FIG. 3 is a cross-sectional view, taken along the line 3—3 of FIG. 2;

FIG. 4 is a left end view of FIG. 2, and

FIG. 5 is a rear end view of FIG. 2.

Accordingly, a dart 10 is shown to include a conical main body 11, fabricated of aluminum or other suitable material. The small diameter end 12, of main body 11, freely engages with one end of a plastic member 13, which includes a tapered tail end portion 14, provided with a pair of transverse and crisscrossed slots 15, that suitably receive stabilizing fins (not shown), which are common in the art for the stabilization of flight.

The large diameter portion of main body 11 includes a centrally extending shank 17, which is terminated by a circular head 18, for contact with a dart target. The shank 17 and head 18 are integral of main body 11, and the outer periphery of head 18 is provided with three annular grooves 19. A steel shaft 20 is fixedly secured, at one end, within a longitudinal bore 21 by suitable means, and bore 21 extends partially through member 13. The opposite end of shaft 20 is freely and rotatably received within the longitudinal bore 22, which extends all the way through main body 11, and a flange 23, integral with the front end of shaft 20, is freely and rotatably received within a recessed opening 24, provided within the front face of head 18.

In use, stabilizer fins are first installed within slots 15, and the body 11 is held in the fingers of the player, and is thrown in a normal manner. When the dart 10 strikes, and adheres to, the target by magnetic force, the player throws a similar dart 10, and if its head 18 strikes any portion of the first dart 10 on the target, the head 18 of the second dart 10 thrown will immediately rotate upon its shaft 20, causing it to strike the target close to the first dart 10 thrown, without being deflected away by the collision impact of the two.

While various changes may be made in the detail construction, it is understood that such changes will be within the spirit and scope of the present invention, as is defined by the appended claims.

What we now claim is:

1. A dart structure, comprising, in combination, a metal, frusto conically-shaped main body, a plastic tail member adjacent a rear end of said main body, said tail member being rearwardly tapered, a plurality of transverse cross slots through a rear portion of said tail member, stabilizing fins being secured in said cross slots, a forwardly extending shank formed integrally with a forward end of said main body and a circular, enlarged head formed on a forward end of said shank, a plurality of annular grooves around said head, and a steel shaft affixed at its rear portion within a longitudinal bore through a front portion of said tail member and a front portion of said steel shaft extending axially through said main body, said shaft being freely and rotatably received in a longitudinal bore through said main body, and a diametrically enlarged flange formed on a forward end of said steel shaft for abutment with a forward face of said head.

* * * * *